United States Patent [19]

Bühler et al.

[11] Patent Number: 4,560,336

[45] Date of Patent: Dec. 24, 1985

[54] APPARATUS FOR PRODUCING DRY-PRESSED MOULDING FROM A PARTICULATE OR GRANULAR MOULDING MATERIAL

[75] Inventors: Eugen Bühler, Schleifweg 3, D-8871 Burtenbach, Fed. Rep. of Germany; Klaus Strobel; Karl Schwarzmeier, Selb, Fed. Rep. of Germany

[73] Assignees: Eugen Bühler, Burtenbach; Hutschenreuther AG, Selb, both of Fed. Rep. of Germany

[21] Appl. No.: 673,533

[22] Filed: Nov. 20, 1984

[30] Foreign Application Priority Data

Nov. 21, 1983 [DE] Fed. Rep. of Germany ..... 3341959

[51] Int. Cl.[4] ..... B28B 3/02; B28B 13/02

[52] U.S. Cl. ..... 425/78; 425/405 H

[58] Field of Search ..... 425/405 H, 405 R, 78

[56] References Cited

U.S. PATENT DOCUMENTS

| | | | |
|---|---|---|---|
| 2,290,910 | 7/1942 | Jeffery | 425/405 H X |
| 3,172,153 | 3/1965 | Loomis et al. | 425/405 H X |
| 3,239,591 | 3/1966 | Wendt | 425/405 H X |
| 3,557,405 | 1/1971 | Bowles | 425/405 H X |
| 3,591,903 | 7/1971 | Bowles | 425/405 H X |
| 3,664,799 | 5/1972 | Wallick et al. | 425/405 H X |
| 3,726,622 | 4/1973 | De Troyer et al. | 425/78 |
| 3,730,666 | 5/1973 | Bowles | 425/405 H |
| 4,043,724 | 8/1977 | Schubart | 425/405 H X |
| 4,157,887 | 6/1979 | Söthje | 425/405 H |
| 4,460,326 | 7/1984 | Eroseck et al. | 425/78 X |
| 4,482,515 | 11/1984 | Bühler et al. | 425/405 H X |

FOREIGN PATENT DOCUMENTS

| | | |
|---|---|---|
| 3101236 | 1/1982 | Fed. Rep. of Germany . |
| 3128348 | 2/1983 | Fed. Rep. of Germany . |
| 3207565 | 9/1983 | Fed. Rep. of Germany . |

*Primary Examiner*—J. Howard Flint, Jr.

*Attorney, Agent, or Firm*—Toren, McGeady, Stanger, Goldberg & Kiel

[57] ABSTRACT

Apparatus for producing moldings from a dry, particulate or granular material such as a ceramic molding composition, comprises a first mold half carried on the base of a press, while a vacuum shooting head, a second mold half and a removal head are carried on a movable carriage supported by a press head of the press. The carriage is displaceable transversely of the pressing direction so that the vacuum shooting head, the second mold half, and the removal head can be successively brought into alignment with the first mold half to allow the molding process to be performed rapidly and continuously without long gaps in the successive pressing stages.

6 Claims, 2 Drawing Figures

APPARATUS FOR PRODUCING DRY-PRESSED MOULDING FROM A PARTICULATE OR GRANULAR MOULDING MATERIAL

BACKGROUND OF THE INVENTION

The present invention relates generally to apparatus for producing dry-pressed moldings from a particulate or granular molding material, such as a ceramic molding composition.

In particular the invention relates to apparatus of the type comprising basically a first mold half, a second mold half and a vacuum shooting head. In such apparatus, with the second mold half removed, the first mold half and the vacuum shooting head can be brought together to define a loading cavity into which the molding composition can be drawn by applying a vacuum. The molding process employed with such apparatus comprises the steps of introducing the molding composition into the loading cavity where it is precompressed into a premolding, bringing the second mold half into alignment with the first mold half after the vacuum shooting head has been removed to leave the premolding behind in the first mold half, and pressing the premolding between the first and second mold halves to form the molding.

Apparatus of this general type used in such a process is known from German Offenlegungsschrift No. 3,101,236, which describes and illustrates apparatus in which the first mold half is designed for isostatic pressing. The essential point in isostatic pressing is that, after the first and the second mold halves have been brought up to each other, a fluid under pressure is introduced behind a press member belonging to one or other of the mold halves. The press member defines the shape of the molding surface of the associated mold half and presses the molding against the other mold half which, if desired, may also be equipped with an isostatic press membrane. As far as the present invention is concerned, however, the two mold halves may be equipped with rigid molding surfaces or with molding surfaces which are formed by elastomeric layers supported so as to be dimensionally rigid during pressing, in which case the surface of the vacuum shooting head which faces into the loading cavity, and the molding surface of the second mold half, are differently shaped in such a way that, despite a varying thickness of molding composition in the loading cavity, that is despite a varying wall thickness of the premolding, an approximately constant degree of compression is obtained in the finished molding as a result of the fact that the compression-molding process starts in the zones where the premolding is relatively thick before it starts in the zones where the premolding is relatively thin.

The procedure described in the above mentioned German Offenlegungsschrift No. 3,101,236 is particularly suitable for processing ceramic materials, such as porcelain, but is also suitable for processing other dry, free-flowing particulate materials, such as coal-containing and metallic molding compositions. In the field of ceramics the process is particularly suitable for producing moldings which are not rotationally symmetrical, that is moldings which cannot be produced on traditional potter's wheels and which therefore have hitherto traditionally been produced by pouring liquid slip into moisture-absorbent hollow plaster molds. The procedure described in the above-mentioned German Offenlegungsschrift No. 3,101,236 offers a significant increase in productivity over the traditional casting technique.

OBJECTS OF THE INVENTION

The primary object of the present invention is to provide apparatus which is suitable for performing th process described hereinabove in relation to German Offenlegungsschrift No. 3,101,236.

Another object of the invention is to make possible additional increases in productivity of the dry-pressing process.

A further object of the invention is to provide apparatus capable of a particularly delicate handling of the resulting moldings.

SUMMARY OF THE INVENTION

According to the present invention apparatus for producing moldings from a dry, free-flowing particulate molding composition comprises a first mold half, a vacuum shooting head which, together with the first mold half, forms a loading cavity into which the molding composition can be drawn by applying a vacuum, the molding composition being pre-compressed to form a premolding in the loading cavity by the loading action, and a second mold half, which is displaceable into and out of a working position in alignment with the first mold half and is movable towards the first mold half thereby to press a premolding in the first mold half to form a molding, in which the vacuum shooting head, the second mold half and a removal head for removing the molding from the first mold half are all carried by a carriage which is mounted on the press head of a press so as to be displaceable transversely of the pressing direction with respect to the first mold half, which latter is carried on a base portion of the press, such that by displacing the carriage with respect to the press head, the vacuum shooting head, the second mold half and the removal head can be successively brought into alignment with the first mold half whereby, in use of the apparatus, in succession, the loading cavity can be filled and a premolding formed, the premolding pressed to form a molding, and the molding removed from the first mold half, the arrangement being such that when the vacuum shooting head and/or the second mold half are in alignment with the first mold half, the removal head is in a transfer position relative to a receiving surface whereby to transfer a molding formed during a preceding cycle to the receiving surface.

Care must be taken in particular to ensure that, on introducing molding material into the loading cavity formed between the first mold half and the vacuum shooting head, the speed at which the particles or granules of the molding material strike the area around the outlets of the air extraction system from the loading cavity is kept sufficiently low to avoid blocking these outlets by compacted molding material particles or granules. Care must also be taken to ensure that the particles of molding material accumulate around the outlets of the air extraction channels in the form of an air-permeable packing (which forms part of the resulting precompressed premolding) whilst also ensuring that the molding material particle impact speed maintained throughout the entire filling process causes sufficient precompression of the resulting premolding to ensure that the premolding thus formed does not collapse even where the sides are steep, when the vacuum shooting head is removed to allow the second mold half to be moved into place. Care must also be taken to ensure that the design of the vacuum shooting head is such that only very little of the molding material, if any at all, is drawn through the air outlets into the air extraction channels.

The increase in productivity gained by use of the apparatus of the invention resides in the fact that the vacuum shooting head, the second mold half and the removal head can be brought in rapid order into alignment with the first mold half, which, together with the premolding carried thereby, is not moved, so that the risk of damaging the premolding is consequently substantially eliminated, even if the degree of precompression should be relatively low.

Moreover, handling of the final molding is also gentle, since the molding is only moved by the apparatus for a short distance with only a small number of changes in direction until it arrives on the receiving surface, which can be, for example, a conveyor belt.

The fact that the finished molding can be in the process of being transferred from the removal head to the receiving surface at the same time as the premolding is being formed in the loading cavity between the vacuum shooting head and the first mold half, leads to a further reduction in the time taken for a complete cycle of operations and hence to a further gain in productivity.

Preferably the press has a pair of parallel guide pillars for the press head and the carriage is displaceable between these guide pillars substantially perpendicularly to a common plane in which the axes of the two guide pillars lie. This arrangement of the carriage relative to the press ensures that little constructional work is necessary to attach the carriage to existing presses and makes it possible to absorb the forces during pressing in such a way that there are no significant twisting moments on the guides by the press head of the press. This latter aspect is also aided if a central axis of the first mold lies in the same common plane as the axes of the guide pillars. The removal head may remove the molding by means of, for example, one or more suction devices.

The molding may be transferred by the removal head to, for example, a conveyor belt which conveys the molding to an onward processing station, for example a station where a decorative motif is applied, or a firing furnace.

A further gain in productivity can be achieved if the carriage supports a plurality of vacuum shooting heads, a plurality of second mold halves, and a plurality of removal heads in respective groups extending across the carriage transversely of its direction of movement. In this case a single press simultaneously produces more than one molding per working cycle.

Various details and advantages of a specific embodiment of the invention will become apparent from a study of the following description thereof in which reference will be made, by way of example, to the accompanying drawings.

DESCRIPTION OF THE PREFERRED EMBODIMENT

Figure 1:
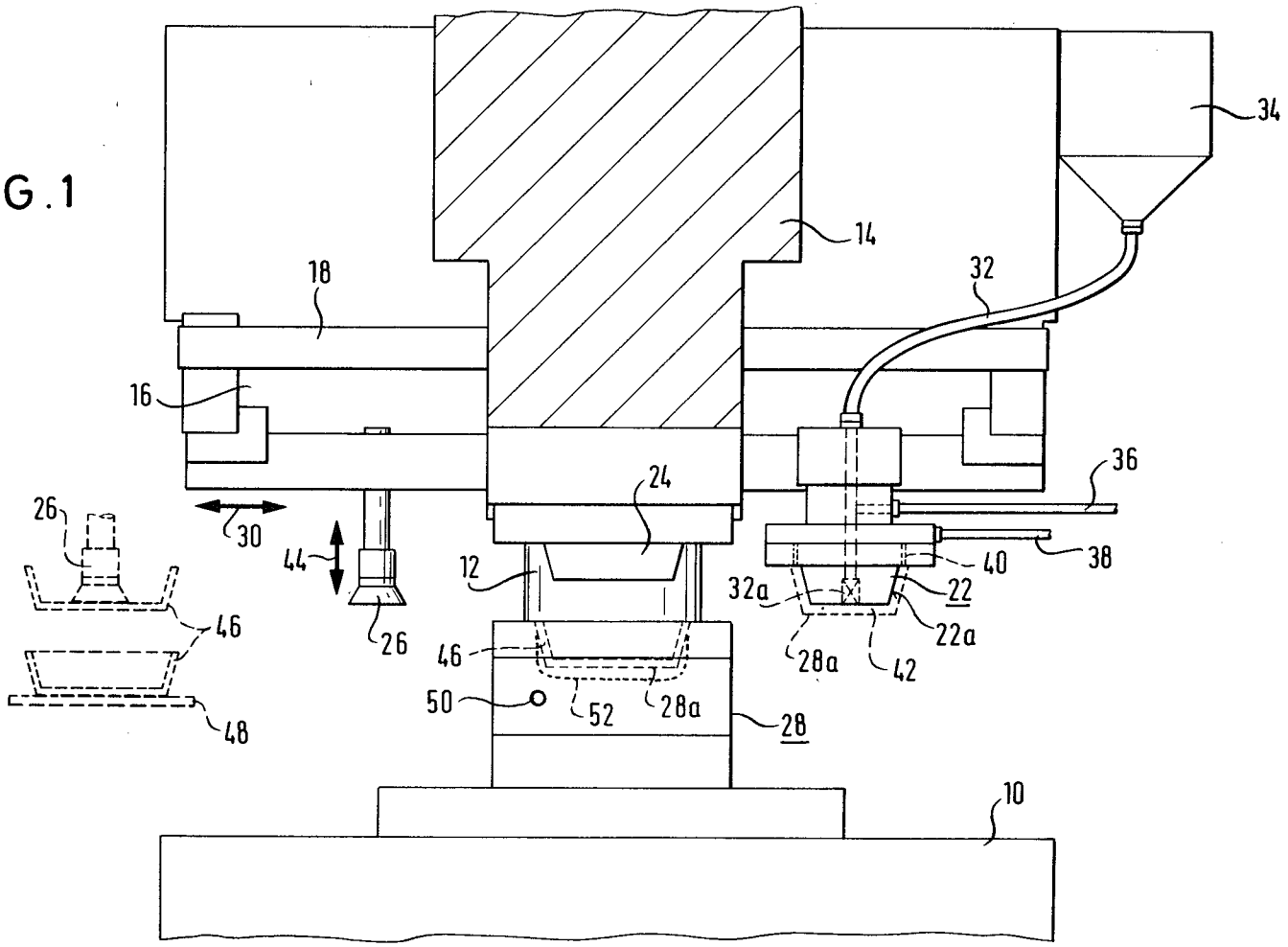
FIG. 1 is a partly sectioned side view, taken on the line I—I of FIG. 2, of apparatus formed in accordance with the principles of the invention, viewed transversely of the direction of motion of the carriage.
Figure 2:
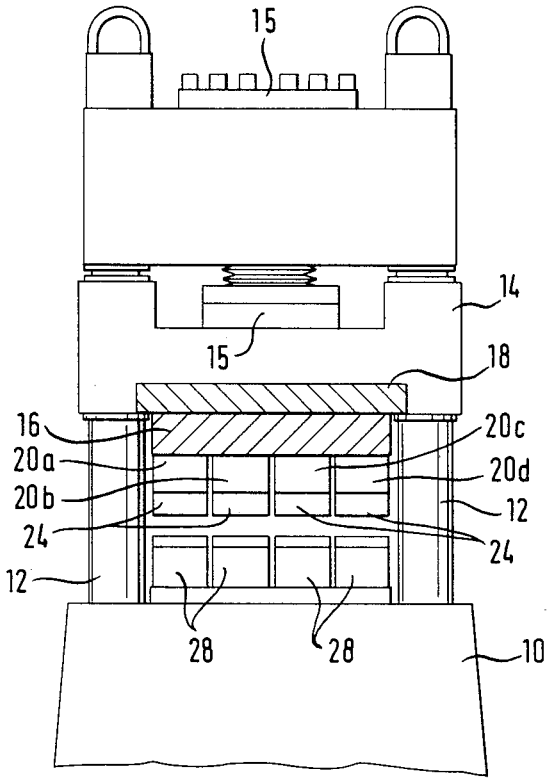
FIG. 2 is a sectional view, taken on the line II—II of FIG. 1, but on a smaller scale, of part of the apparatus illustrated in FIG. 1.

In FIGS. 1 and 2 of the drawings, the base portion of a press is identified with the reference numeral 10. Supported by the base portion 10 there are two guide pillars 12. A set of first mold halves 28, in the illustrated embodiment four, are arranged on the base portion 10 of the press between the guide pillars 12.

A press head 14 is guided for vertical displacement by the guide pillars 12. A hydraulic press 15 is provided for moving the press head 14. Between the two guide pillars 12, beneath the press head 14 and above the first mold halves 28 is located a carriage 16 which is horizontally displaceable on a guide bed 18. The carriage 16 carries a plurality of vacuum shooting heads 22, a plurality of second mold halves 24 and a plurality of removal heads 26 which are arranged in rows across the carriage as can be seen in FIG. 2 which particularly illustrates a row of four second mold halves 24 carried by respective supports 20*a*, 20*b*, 20*c* and 20*d* suspended from the carriage 16.

The carriage 16 is displaceable in the direction indicated by the double arrow 30. In a first working position of the carriage, the vacuum shooting heads 22 are in vertical alignment with respective first mold halves 28 and, together with the latter, define respective molding cavities 42. Each vacuum shooting head 22 is connected, as shown in FIG. 1 to a molding composition funnel 34 by way of an air line 32. Each vacuum shooting head 22 is also connected to a fluidising air line 36 and to an evacuating line 38. To fill a loading cavity 42 formed between a surface 22*a* of a vacuum shooting head 22 and a mold face 28*a* of the associated first mold half 28, a vacuum is generated therein via the evacuating line 38 and passages 40 in the vacuum shooting head 22. The molding composition is drawn in by the vacuum upon opening a valve 32*a* at the entry point of the line 32 into the loading cavity 42 and, if desired, is fluidised by fluidising air which is let into the flowing molding composition through line 36. A precompressed premolding thus forms in the loading cavity 42.

This premolding remains in the first mold half 28 when the vacuum shooting head is then raised by raising the press 15 and is displaced laterally by means of the carriage 16, into the position shown in FIG. 1. The second mold halves are then in vertical alignment above the first mold halves 28 and the premolding in each can be pressed by the press head 14 on lowering the press 15 to form the final molding by moving each second mold half 24 downwards. Each molding thus acquires a strength, at the latest during the course of this pressing, which is sufficient to allow it subsequently to be removed from the first mold half 28 and to be passed on to an onward processing station However, it is also possible for the premolding, while still in the loading cavity 42 between the vacuum shooting head 22 and the first mold half 28, to receive a further precompression treatment by displacing the vacuum shooting head 22 towards the first mold half 28 after the loading has been completed. This further precompression is additional to the precompression caused by the impact of the particles of the molding composition upon introduction into the loading cavity.

Once a molding has been finally pressed between a first mold half 28 and a second mold half 24, and the second mold half 24 has been raised, together with the press head 14, the carriage 16 is shifted further towards the right so that each removal head 26 is brought into alignment with the associated first mold half 28. The removal heads 26 are then lowered as indicated by the double arrow 44 to engage the moldings 46 in the first mold halves 28. When the removal heads 26 are again raised each takes with it the associated finally pressed molding, and the carriage 16 then returns to the initial left-hand end position in which the vacuum shooting heads 22 are again in vertical alignment with the first mold halves 28 and the removal heads 26, as shown in broken outline on the left-hand side of FIG. 1, are again in the transfer position relative to a conveyor belt 48. The removal heads 26 are then lowered with the carriage still in this position and the moldings 46 are thus placed onto the conveyor belt 48.

As illustrated in FIG. 1 the first mold half 28 is shown with a connection point 50 for a pressure medium for injection behind an optional isostatic press membrane generally represented by the dotted line 52.

If in the course of its production the molding 46 is also to be decorated, this can be done using the process described in German Offenlegungsschrift No. 3,207,565 the contents of which document are incorporated herein by reference. It is possible, for example, for decoration-applying means of the type shown in FIG. 2 of the above mentioned German Offenlegungsschrift No. 3,207,565 to be allocated to each second mold half 24 of the apparatus illustrated in FIG. 1, between the conveyor belt 48 and the first mold half 28, in such a way that this decoration-applying means comes into alignment with a second mold half 24 when the carriage 16 is in the most extreme position on the lefthand side, this being the position in which the vacuum shooting heads 22 are in alignment with the first mold halves 28. Each second mold half 24 could then be provided with a decorative layer during the period when the moldings 46 are being transferred by the removal heads 26 to the conveyor belt 48.

Although a machine having four first mold halves 28 in a row, and a corresponding number of second mold halves 24, vacuum shooting heads 22 and molding removal heads 26 has been described by way of example, it will be appreciated that other embodiments of the invention may be formed in which a different number, even only one, first mold half 28 is provided, in which case, correspondingly, only one second mold half 24, one vacuum shooting head 22 and one molding removal head 26 would be required.

What is claimed is:

1. In apparatus for producing moldings from a dry, particulate or granular material such as a ceramic molding composition, of the type comprising:

a first mold half, a vacuum shooting head which, together with said first mold half, forms a loading cavity, vacuum applying means for applying a vacuum to said loading cavity to draw said molding material into said loading cavity where it is precompressed to form a premolding, and a second mold half, said second mold half being displaceable into and out of a working position in alignment with said first mold half and being movable towards said first mold half whereby to press a premolding in said first mold half to form a molding;

the improvement wherein said vacuum shooting head, said second mold half and a removal head for removing said molding from said first mold half are all carried by a single carriage, said carriage being mounted on the press head of a press so as to be displaceable transversely of the pressing direction with respect to said first mold half, a base portion of said press carrying said first mold half such that by displacing said carriage with respect to said press head transversely of said pressing direction, said vacuum shooting head, said second mold half and said removal head are successively displaceable into alignment with said first mold half whereby, in use of said apparatus, said loading cavity can be filled and a premolding formed, and in succession, said premolding can be pressed to form a molding, and said molding can be removed from said first mold half, the arrangement being such that when said vacuum shooting head, and/or said second mold half are in alignment with said first mold half, said removal head is in a transfer position relative to a receiving surface whereby to transfer a molding formed during a preceding cycle to said receiving surface.

2. The apparatus of claim 1, wherein said press has a pair of parallel guide pillars for said press head and said carriage is displaceable between these guide pillars substantially perpendicularly to a common plane in which the axes of said two guide pillars lie.

3. The apparatus of claim 2, wherein a central axis of said first mold half lies in the same common plane as the axes of said guide pillars.

4. The apparatus of claim 1, wherein said removal head is provided with at least one suction device for picking up a finished molding from said first mold half.

5. The apparatus of claim 1 wherein said receiving surface comprises a conveyor belt.

6. The apparatus of claim 1, wherein said carriage supports a plurality of said vacuum shooting heads, a plurality of said second mold halves and a plurality of said removal heads, in respective groups extending across said carriage transversely of its direction of movement.

* * * * *